US010687608B2

(12) United States Patent
Moreau et al.

(10) Patent No.: US 10,687,608 B2
(45) Date of Patent: Jun. 23, 2020

(54) LANYARD CLAMPING METHOD AND APPARATUS

(71) Applicant: Ty-Flot, Inc., Manchester, NH (US)

(72) Inventors: Darrell A. Moreau, Manchester, NH (US); Andre W. Moreau, Bedford, NH (US); Reginald J. Moreau, Litchfield, NH (US)

(73) Assignee: Pure Safety Group, Inc., Pasadena, TX (US)

( * ) Notice: Subject to any disclaimer, the term of this patent is extended or adjusted under 35 U.S.C. 154(b) by 231 days.

(21) Appl. No.: 15/208,314

(22) Filed: Jul. 12, 2016

(65) Prior Publication Data

US 2017/0119138 A1 May 4, 2017

Related U.S. Application Data

(60) Provisional application No. 62/248,529, filed on Oct. 30, 2015.

(51) Int. Cl.

| | |
|---|---|
| ***A45F 5/02*** | (2006.01) |
| ***A44B 13/00*** | (2006.01) |
| *A45F 5/00* | (2006.01) |

(52) U.S. Cl.

CPC ..... *A45F 5/02* (2013.01); *A44B 13/00* (2013.01); *A45F 2005/006* (2013.01)

(58) Field of Classification Search

CPC . A44B 13/00; A44B 11/12; A44B 6/00; A45F 2005/006; A45F 5/02; A45F 5/00

USPC ..... 24/459–462

See application file for complete search history.

(56) References Cited

U.S. PATENT DOCUMENTS

| | | | | |
|---|---|---|---|---|
| 2,454,103 | A * | 11/1948 | Swidersky | A44B 99/00 24/459 |
| 5,279,021 | A * | 1/1994 | Edgin | F16B 45/02 24/3.6 |
| 5,842,256 | A * | 12/1998 | Anscher | A44B 99/00 24/3.4 |
| 8,336,173 | B2 * | 12/2012 | Pontaoe | A44B 99/00 24/265 EC |
| 2016/0143384 | A1 * | 5/2016 | Moreau | A42B 3/08 2/410 |

* cited by examiner

*Primary Examiner* — Robert Sandy
*Assistant Examiner* — Louis A Mercado
(74) *Attorney, Agent, or Firm* — Dicke, Billig & Czaja, PLLC

(57) ABSTRACT

A tethering method includes providing a tether clamp with a mouth portion and a throat portion, where the tether clamp is operable between an open position and a closed position; providing a wearable garment made of pliant material; providing a clamping body sized to pass through the mouth portion and remain disposed in the throat portion of the tether clamp when in the closed position; folding the pliant material of the wearable garment over the clamping body; installing the clamping body with folded material into the throat portion of the tether clamp with the clamping body extending axially through the throat portion and the folded material extending out through the mouth portion; and closing the tether clamp to capture the clamping body with folded material in the throat portion and engage at least two plies of the pliant material in the mouth portion.

19 Claims, 8 Drawing Sheets

LANYARD CLAMPING METHOD AND APPARATUS

BACKGROUND OF THE INVENTION

1. Field of the Invention

The present invention relates generally to drop-prevention equipment and methods. More particularly, the present invention relates to a method of attaching a tether clamp to an object made of pliant material and apparatuses for doing so.

2. Description of the Prior Art

Lanyards, tethers, hooks, and similar restraints are used to prevent accidental dropping of tools and other equipment. These restraints are particularly useful for workers at height and in environments where a tool drop can cause substantial damage or harm to plant equipment, to workers, or to objects below a worker who accidentally drops a tool.

One method of tethering a tool includes attaching one end of a tether to an opening in the handle of a tool (e.g., an adjustable wrench) and to clamp the other end of the tether to a ring on the worker's belt or looping the tether around a nearby structure. When workers properly tether a tool in this way, accidental drops can be eliminated or greatly reduced.

In the field of foreign material exclusion (FME), as practiced for example at nuclear power facilities, workers use procedures and equipment to prevent foreign objects from being left or dropped into sensitive areas. For example, tools, connectors, trash, and other items that inadvertently fall into a vessel of cooling water require that the system be shut down before the item can be retrieved. Using tethers to secure tools, hard hats, writing implements, and other objects is one practice that reduces inadvertent drops.

Workers on a construction site typically use tool belts or other equipment that have attachment points, D-rings, or other features that enable secure attachment of a tether. In other work environments such as laboratories and chemical plants, however, the worker dons a coverall or other protective clothing. For example, some disposable coveralls are made of a woven polyethylene material made by DuPont and sold under the trademark Tyvek®. Other protective garments are made of spunbound polypropylene, polypropylene, polyolefin, cotton, nylon, paper, and other materials that are relatively thin and have a smooth surface. For safety purposes, these protective garments typically lack pockets and other storage compartments that could collect hazardous materials in the event of a splash, spill, or accident. Absent pockets, workers often choose to wear a lanyard around the neck or clip a lanyard to the garment to secure writing implements, access credentials, and small tools.

To prevent a lanyard from being pulled from its point of attachment on the garment, one approach is to use a spring clip that engages the garment material between the jaws of the clip. Due to the thin and smooth finish of the garment, some users select clamps with teeth.

SUMMARY OF THE INVENTION

Coveralls, smocks, aprons, and other protective garments are often made of thin, smooth materials. This is especially true when the garment is intended to be disposable. For tethering very light weight objects, an alligator clip or spring clip will sufficiently grip such a garment. Traditionally, clamps attached to exclusion garments have a load rating of only 1.5 pounds or much less. However, for heavier objects such as a hard hat or hand tool, the 1.5-lb. load is easily exceeded when the object is dropped. As a result, a lanyard clipped to the garment simply pulls free from the garment material even when a heavy-duty clamp with teeth is used. The garment material simply slips through the teeth or jaws of the clamp because the garment material is so thin and smooth that it is difficult to grasp. When toothed clamps pierce the garment material, the garment becomes prone to being ripped when the tether is subjected to small loads.

FIGS. 1A-1D illustrate perspective views of prior-art clips and clamps used as a tether clamp 10. Each tether clamp 10 defines a mouth portion 22 and a throat portion 24. Clamps of FIGS. 2A, 2B, and 2C also define one or more teeth 20. Tether clamp 10 of FIG. 1A is a lever-operated clamp made of plastic. Tether clamp 10 of FIG. 1B is a suspender-type clip made of plastic or metal and includes nylon teeth 20. Tether clamp 10 of FIG. 1C is a glove clip made of plastic where squeezing together the grip portions of the tether clamp 10 causes mouth portion 22 to open. Tether clamp 10 of FIG. 1D is a binder clip made of metal and has a width of about 0.75 inch and a throat depth of about 0.375 inch.

FIG. 2A shows tether clamp 10 of FIG. 1A in a closed position with a clamp lever 11 pivoted down toward a clamp body 14. The clamp lever 11 includes a handle portion 12 and a clamping portion 16. The clamp body 14 has a mouth portion 22 and a throat portion 24 extending into clamp body 14 from the mouth portion 22. Clamp body 14 also has a lower body arm 18 and an upper body arm 19 that extend in a spaced-apart relation to define mouth portion 22 and throat portion 24. The clamp lever 11 is rotatably attached to the upper body arm 19 so as to rotate about axles 21 extending laterally from each side of clamp lever 11 and into upper body arm 19. In the closed position shown in FIG. 2A, clamping portion 16 is positioned in close proximity to the lower body arm 18. Teeth 20 on the clamping portion 16 and/or the lower body arm 18 are part of a clamping structure 25 that engages and grips an object in the mouth portion 22.

FIG. 2B illustrates tether clamp 10 of FIG. 1A in an open position with the clamp lever 11 rotated up and away from upper body arm 19. In the open position, the clamping portion 16 is moved away from the lower body arm 18, leaving the mouth portion 22 open to receive an object. The throat portion 24 of tether clamp 10 has a throat portion depth 26 measured from the mouth portion 22.

FIG. 3A illustrates a side elevational view of tether clamp 10 of FIG. 1A engaging a piece of garment material 30 folded on itself, where two plies of garment material 30 are held between teeth 20. When garment material 30 is thin and/or smooth, such as with disposable exclusion garments, tether clamp 10 tends to pull off of or separate from garment material 30 when the tethered object is dropped. This occurs for some tether clamps 10 because the tortuous path between teeth 20 and/or the spacing between teeth 20 is optimized for use with thicker garment materials 30 and other objects. To make a tether clamp 10 more universally useful, manufacturers may choose to space teeth 20 for the most common garment materials 30, which results in an ineffective grip on thin, smooth garment materials 30.

FIG. 3B illustrates a side elevational view of the tether clamp 10 of FIG. 1A engaging garment material 30 in another traditional method, where garment material 30 has been folded on itself twice to provide four layers 30*a*-30*d* between the teeth 20 on clamping portion 16 and on lower body arm 18. Even when four layers of the garment material 30 are clamped between the teeth 20, the smooth and slippery finish of some garment materials 30 results in a coefficient of friction that allows the garment material 30 to be pulled from the grip of the tether clamp 10.

Since the teeth 20 of the tether clamp 10 generally do not contact each other, but instead define a serpentine path through the teeth 20, a thin garment material 30 can be pulled relatively easily from of the grip of the tether clamp 10. When the garment material 30 has a low coefficient of friction between adjacent layers, the tether clamp 10 can be similarly pulled from the garment material 30. Garment material 30 also may fail to maintain its folded configuration as individual plies of the garment material 30 pull out of the mouth portion 22 of the tether clamp 10.

Therefore, what is needed is an improved method of securing a tether clamp to garments and other objects made of pliant garment material, especially thin, slippery materials used for disposable gowns and coveralls in exclusion industries. The present invention addresses this need by providing a method of attaching a tether clamp to a garment and apparatuses for doing so.

One aspect of the present invention is directed to a method of attaching a tether clamp to a wearable garment or other object made of a pliant material. In one aspect of the present invention, a tethering method includes the steps of providing a tether clamp that has a clamp body having a mouth portion and a throat portion extending into the clamp body from the mouth portion. The tether clamp is operable between an open position and a closed position. For example, the tether clamp has a clamp lever with a handle portion and a clamping portion operable between an open position and a closed position. The method also includes providing a wearable garment made of a pliant material; providing an elongated clamping body extending from a first end to a second end, where the clamping body is sized to pass through the mouth portion and remain disposed in the throat portion of the clamp body when the tether clamp is moved to the closed position; folding the pliant material over the clamping body, thereby providing the clamping body with folded material; installing the clamping body with folded material into the throat portion of the tether clamp with the clamping body extending axially through the throat portion and the folded material extending through the mouth portion; and moving the tether clamp to the closed position, thereby capturing the clamping body with folded material in the throat portion and engaging at least two plies of the pliant material in the mouth portion.

In another embodiment, the method also includes bringing together the pliant material to define a first material fold, where the step of folding the pliant material over the clamping body is performed by folding the first material fold over the clamping body. In such an embodiment, three or four plies of garment material are gripped in the mouth portion of the tether clamp when moved to the closed position. In one embodiment, the step of bringing together the pliant material together is performed by folding a material free end on itself.

In another embodiment, the step of providing the wearable garment includes selecting the material from nylon, disposable paper, dissolvable paper, polyester, cotton/polyester blend, 100% cotton, silk, spun-bond polyolefin, polyethylene, or polypropylene. In some embodiments, the garment material has a thickness less than 0.050 inch, less than 0.030 inch, less than 0.020 inch, or less than 0.010 inch.

In another embodiment, the step of providing the clamping body includes selecting the clamping body as an elongated portion of a closed-loop connector. For example, the tether body is a straight segment of a D-ring connector. In other embodiments, the closed-loop connector is a buckle, a square ring loop, or a slide buckle.

In some embodiments, the first end and the second end of the clamping body are each sized greater than the throat portion, thereby preventing the clamping body from passing axially through the throat portion of the clamp body when the clamping portion is in the closed position.

In another embodiment, the step of providing the tether clamp includes selecting the clamp to include a lanyard secured at one end to the tether clamp and having a second end adapted to be secured to an object to be tethered.

In another embodiment, the step of providing the tether clamp includes selecting the tether clamp as a spring clamp, a lever-operated clamp, a squeeze-action clamp, or a suspender clamp. In some embodiments, the tether clamp is selected to include a plurality of teeth in the mouth portion, such as on the lower clamp body and/or on the clamping portion of the clamp lever.

Another aspect of the present invention is directed to the combination of a tether clamp, a clamping body, and a wearable garment. In one embodiment, the tether clamp includes a clamp body with a mouth portion and a throat portion extending into the clamp body from the mouth portion, where the tether clamp is operable between an open position and a closed position. For example, the tether clamp has a clamp lever with a handle portion and a clamping portion, where the lever is operable to convert the tether clamp between the open position and the closed position. The clamping body extends from a first end to a second end and is sized to pass through the mouth portion and remain disposed in the throat portion when the clamp lever is moved to the closed position. The wearable garment made of a pliant material with a material thickness less than 0.030 inch.

In some embodiments, the pliant material is selected from nylon, disposable paper, dissolvable paper, polyester, cotton/polyester blend, 100% cotton, silk, spun-bond polyolefin, polyethylene, or polypropylene.

In other embodiments, the material thickness is less than 0.020 inch or less than 0.010 inch.

In some embodiments, the clamping body is a portion of a closed-loop connector, such as a D-ring, a buckle, a square ring loop, or a slide buckle.

In some embodiments, the clamping body is secured within a compartment defined by the pliant material. For example, the compartment is within a first material fold defined by the garment material being folded on itself. The compartment may be, for example, a hem, pocket, pouch, or seam in a garment.

DETAILED DESCRIPTION

Figure 4:
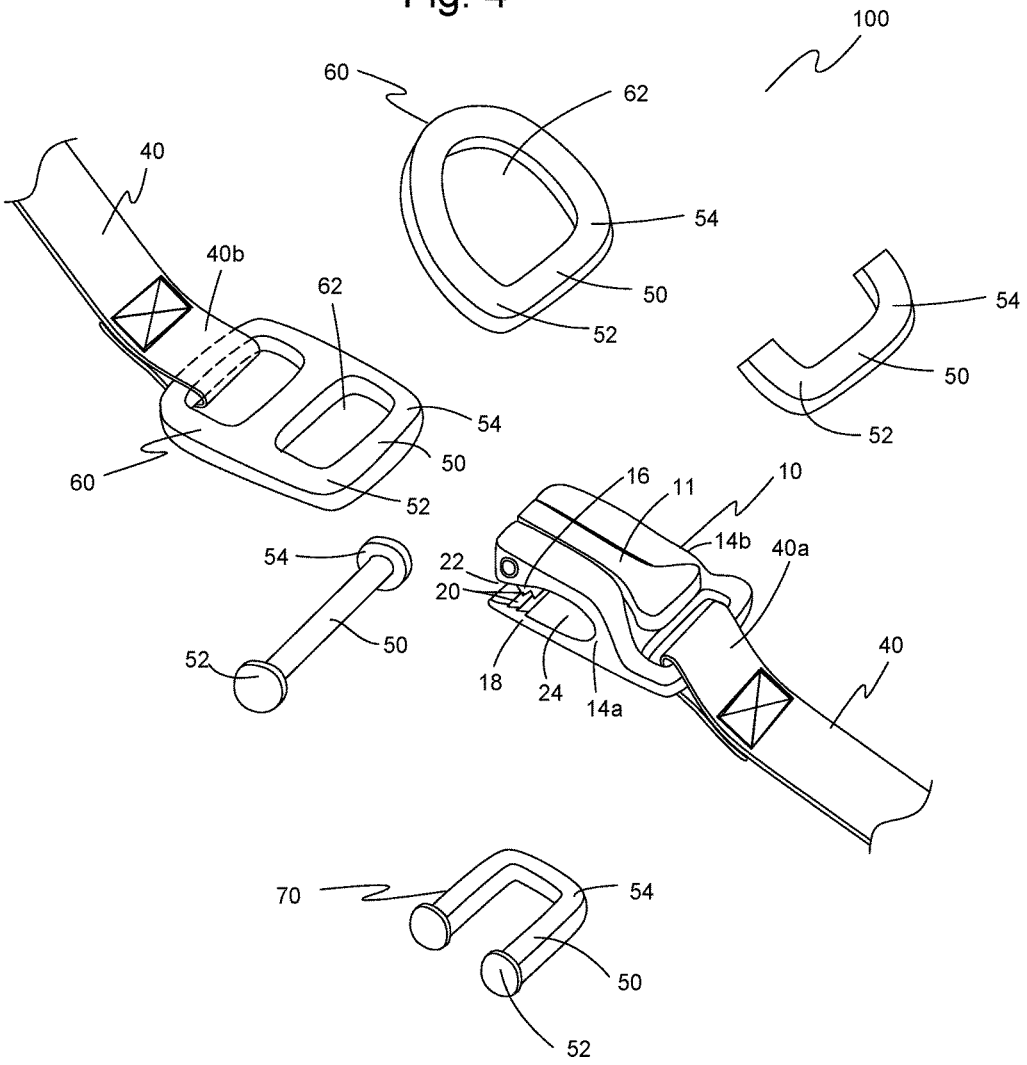
FIG. 4 illustrates a perspective view showing one embodiment of a tether clamp assembly with various embodiments of clamping bodies useful for performing methods of the present invention.

Embodiments of the present invention are illustrated in FIGS. 4-10. Referring to FIG. 4, a tether clamp assembly 100 includes a tether clamp 10 shown in FIG. 1A and a plurality of clamping body structures usable as a clamping body 50 that may be received in throat portion 24 of tether clamp 10. Embodiments of tether clamp assembly 100 (i.e., tether clamp 10 and clamping body 50) are useful for performing attachment methods of the present invention.

As an option, tether clamp assembly 100 includes a tether 40 with a first tether end 40*a* and a second tether end 40*b*, where first tether end 40*a* is secured to tether clamp 10. In some embodiments, second tether end 40*b* of tether 40 is secured to a closed loop connector 60 that includes clamping body 50. In other embodiments, second tether end 40*b* extends through or otherwise attaches to an object to be tethered, such as a hard hat or hand tool.

Figure 2A:
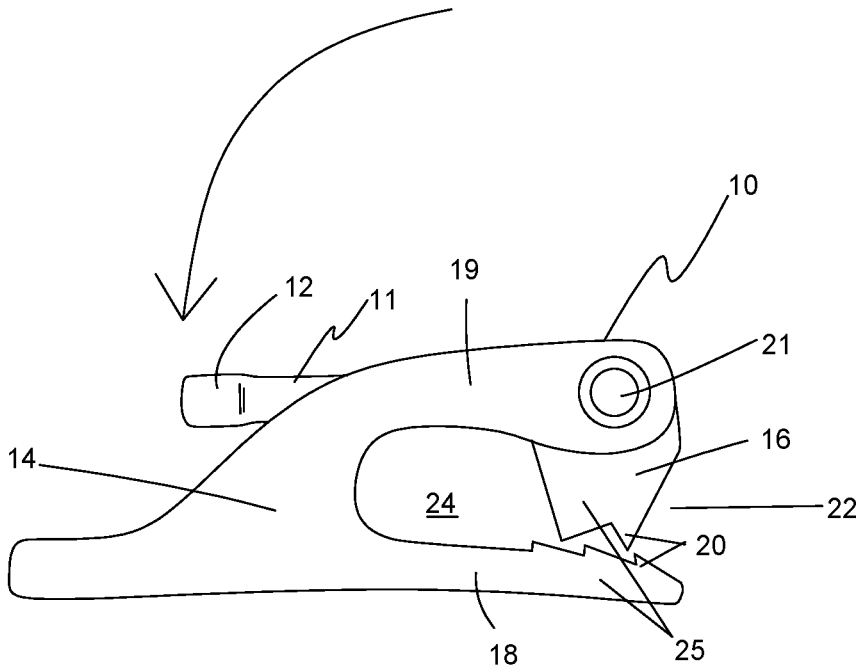
Fig. 2A (prior art)
FIG. 2A illustrates a side elevational view the tether clamp of FIG. 1A showing the tether clamp in a closed position.
Figure 2B:
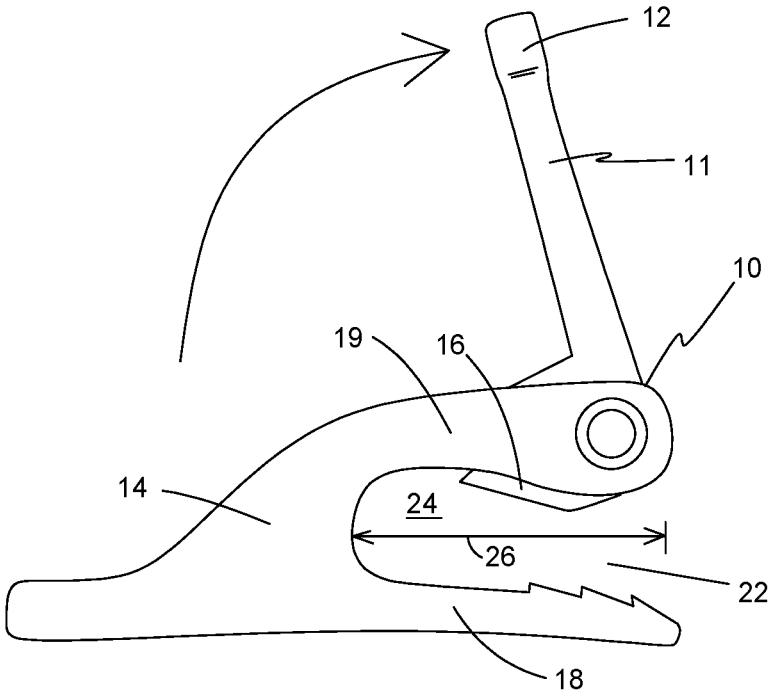
Fig. 2B (prior art)
FIG. 2B illustrates a side elevational view of the tether clamp of FIG. 1A showing the tether clamp in an open position.

As discussed above with reference to FIGS. 2A-2B, tether clamp 10 shown in FIG. 4 is a lever-operated clamp with a clamp lever 11 and a body portion 14. In one embodiment, clamp body 14 defines a mouth portion 22 and a throat portion 24 extending into clamp body 14. A first body side 14*a* and a second body side 14*b* of clamp body 14 are shown as open at throat portion 24, but body sides 14*a*, 14*b* may be closed in some embodiments of tether clamp 10. When body sides 14*a*, 14*b* are open, clamping body 50 typically extends through mouth portion with first end 52 and second end 54 protruding beyond first body side 14*a* and second body side 14*b*, respectively. However, this is not required. Clamping body 50 optionally may reside entirely within mouth portion 22 between body sides 14*a*, 14*b* regardless of whether body sides 14*a*, 14*b* are open or closed.

Clamping body 50 may be made of rigid or flexible materials, including but not limited to metal, plastic, rubber, cloth, and paper. Clamping body 50 may have a variety of forms, such as a cylinder, a roll, a block, a wad, a ball, or other shape provided that clamping body 50 can be received in and retained in throat portion 24 of tether clamp 10. In some embodiments, clamping body 50 has an overall length that is commensurate with a width of tether clamp 10 as measured from first body side 14*a* to second body side 14*b* at throat portion 24. That is, when the width of tether clamp 10 is on the order of a few inches or less, the overall length of clamping body 50 is on the order of a few inches or less. For example, clamping body 50 is no more than twice the width of tether clamp 10. In other embodiments, clamping body 50 has an overall length less than the width of tether clamp 10. In yet other embodiments, such as when clamping body 50 is encased in a hem of the wearable garment, the overall length of clamping body 50 is much larger than the width of tether clamp 10.

In embodiments where body sides 14*a*, 14*b* are closed, for example, clamping body 50 may be a BB, pellet, ball, block, wad of fabric, rod of short length, or similar structure. Garment material 30 may then folded or bunched over and around clamping body 50 and then inserted through mouth portion 22 with clamping body positioned in throat portion 24 and with garment material 30 extending out through mouth portion 22. As tether clamp 10 is moved to the closed position, clamping body 50 is captured in throat portion 24. Thus, like an elongated clamping body 50 that extends through throat portion 24 and slightly beyond body sides 14*a*, 14*b*, clamping body 50 that is a ball, short rod, or the like that fits in throat portion 24 between body sides 14*a*, 14*b* may similarly be retained in throat portion when tether clamp 10 is moved to the closed position.

In some embodiments, mouth portion 22 includes a plurality of teeth 20 extending from clamping portion 16 and/or lower body arm 18. For example, teeth 20 extend from clamping portion 16 and lower body arm 18 in opposite directions to define a serpentine path between them. A clamping structure 25 includes clamping portion 16, mouth portion 22, and optional teeth 20. Operating together, components of clamping structure 25 engage and grip a garment material 30 in mouth portion 22. For example, clamping structure 25 includes clamping portion 16, lower body arm 18, teeth 20 on clamping portion 16, and teeth 20 on lower body arm 18. As clamp lever 11 is operated to the closed position as shown, clamping portion 16 is brought into close proximity with lower body arm 18 so that teeth 20 engage and grip garment material 30.

Other embodiments of tether clamp 10 are acceptable and include spring clips and clamps, clips and clamps without springs, alligator clips, squeeze-action clamps, resilient clips, screw-operated clamps, clothing clamps, and other clips/clamps that are operable between an open position and a closed position, where the tether clamp 10 in the closed position is capable of engaging and gripping an object placed in the mouth portion 22 and having throat portion 24 to receive clamping body 50.

Clamping body 50 extends longitudinally from a first end 52 to a second end 54. In some embodiments, clamping body 50 has a length greater than the width of throat portion 24 as measured from first body side 14*a* to second body side 14*b*. Clamping body 50 may have various cross-sectional shapes, such as circular, rectangular, ovoid, and other shapes, where the cross-sectional shape optionally corresponds to the shape of throat portion 24 and is sized to be received in throat portion 24 through mouth portion 22. In some embodiments, clamping body 50 has a dumbbell shape or the like, where first end 52 and/or second end 54 have a cross-sectional area greater than a cross-sectional area of throat portion 24 so that clamping body 50 cannot pass out of body sides 14*a*, 14*b* of throat portion 24. Such a feature helps to prevent tether clamp 10 from sliding off of ends 52, 54 of clamping body 50 along the axial direction of clamping body 50.

In some embodiments, clamping body 50 is a stand-alone object; in other embodiments, clamping body 50 is part of a closed-loop connector 60. Closed loop connector 60 may be a D-ring, a buckle, a square loop connector or other object having an opening 62 and defining clamping body 50 with a size and shape to be received in throat portion 24 through mouth portion 22 of tether clamp 10. For example, clamping body 50 is an elongated segment of a D-ring connector. In another example, clamping body is a ball connected to a flexible loop or closed-loop connector 60. In yet other embodiments, clamping body 50 is part of an open connector 70, such as one having a U-shape. Closed-loop connector 60 and open connector 70 may define first end 52 and/or second end 54 by a change in direction or corner that defines a stop for tether clamp 10.

Figure 5A:
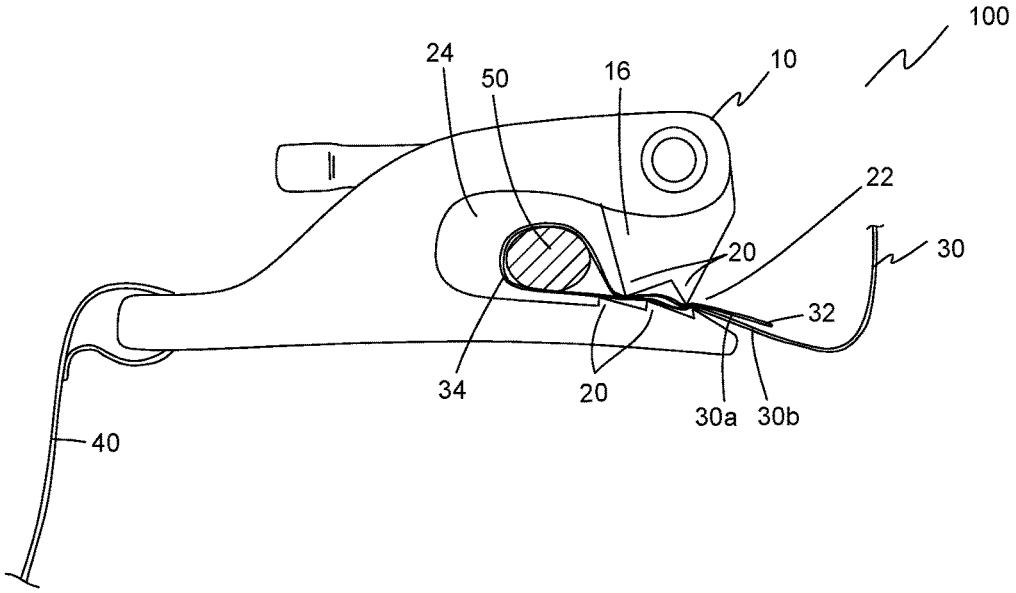
FIG. 5A illustrates the tether clamp of FIG. 1A showing the result of one embodiment of a method of attaching a tether clamp of the present invention showing the tether clamp attached to material folded over a clamping body.

Referring now to FIG. 5A, a side elevational view illustrates the clamping configuration of the tether clamp assembly 100 showing tether clamp 10 attached to a wearable garment or other object made of a pliable garment material 30. Here, garment material 30 is folded over and around clamping body 50 (shown in cross section), where clamping body 50 extends axially through throat portion 24 of tether clamp 10. Garment material 30 may be in the form of a shirt, smock, apron, coverall, or other garment. Optionally, garment material has a free end 32, such as along a bottom edge of a smock or shirt. For example, free end 32 may be a shirt tail, pocket flap, collar, cuff, neck opening, arm opening, front opening, or other portion of the garment. As used herein, the term "garment material" 30 includes not only fabrics and textiles of woven, knitted, and felted fibers, but also non-woven, pliant materials in sheet form, synthetic materials, cloth, leather, plastics, paper, and any other pliant material used to make wearable garments and other wearable objects, such as tool pouches, bags, and the like.

Figure 5B:
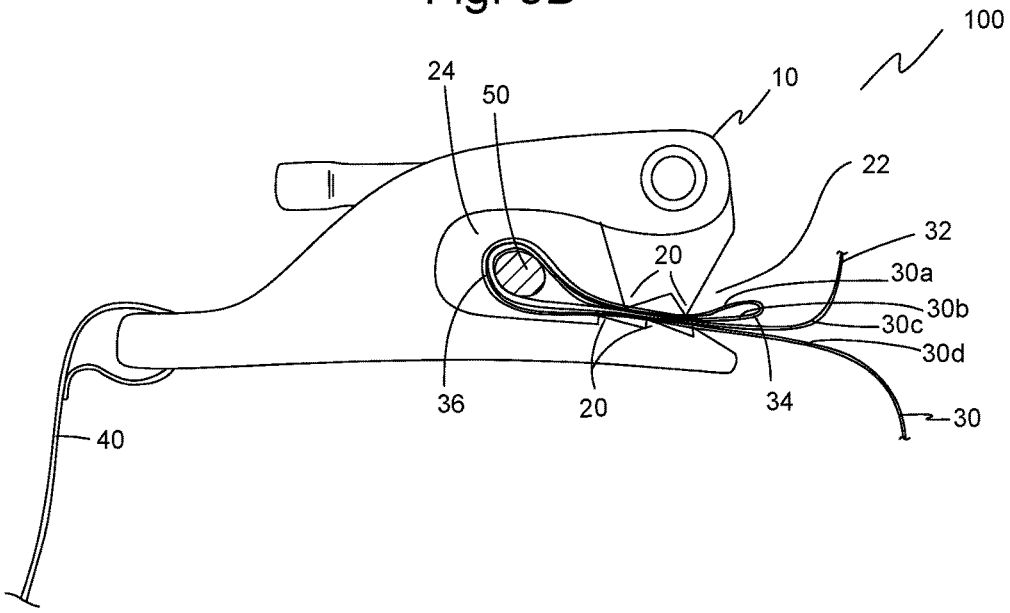
FIG. 5B illustrates the tether clamp of FIG. 1A showing the result of another embodiment of a method of attaching a tether clamp of the present invention showing the tether clamp attached to material folded over a clamping body in a four-ply installation.

Referring now to FIG. 5B, a side elevational view illustrates the clamping configuration of tether clamp assembly 100 and garment material 30 showing a multiple-ply garment fold. As with the traditional clamping structure shown in FIG. 3, garment material 30 is folded on itself to result in four layers 30*a*-30*d* between teeth 20. However, unlike the traditional clamping method shown in FIG. 3, the clamping setup of FIG. 5B includes clamping body 50 positioned in throat portion 24 of tether clamp 10 and extending axially therethrough with garment material 30 folded over clamping body 50. As shown in FIG. 5B, garment material 30 is first folded on itself to define a first material fold 34. Then, the folded (2-ply) garment material 30 defining first material fold 34 is folded over clamping body 50 to provide four layers of garment material 30 extending through mouth portion 22 between teeth 20. Clamping body 50 extends between plies of garment material 30 defining a second material fold 36 located in throat portion 24 and prevents garment material 30 from being pulled through teeth 20 of tether clamp 10. Clamping body 50 has a cross-sectional area sized to not pass through mouth portion 22 when tether clamp 10 is in the closed position.

Figure 6:
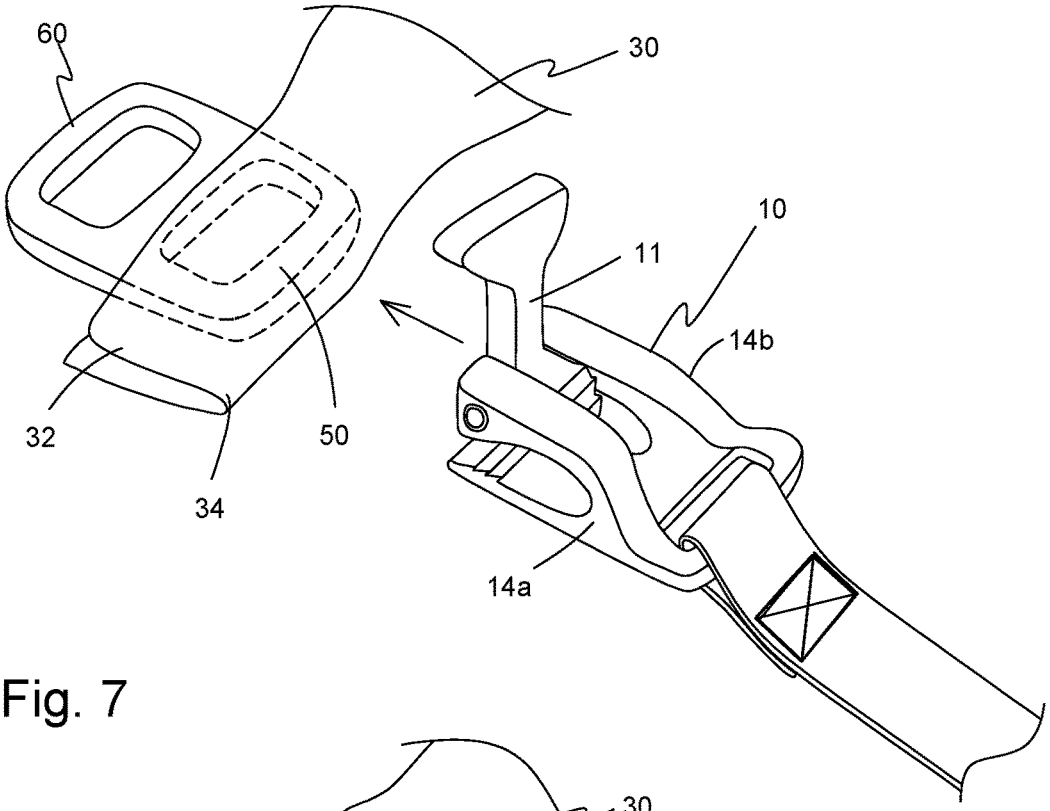
FIG. 6 illustrates a perspective view of a tether clamp assembly showing a tether clamp prior to installation on material folded over a clamping body consistent with embodiments of the methods of the present invention.

Referring now to FIG. 6, a perspective view shows tether clamp 10 with clamp lever 11 moved to the open position and ready for attachment to closed-loop connector 60 while garment material 30 is folded over clamping body 50. Here, clamping body 50 is an elongated segment of closed-loop connector 60 having a length sufficient for tether clamp 10 to extend through throat portion 14 and beyond body sides 14*a*, 14*b* of tether clamp 14. Opening 62 of closed-loop connector 60 is sufficiently large to allow clamping portion 16 of tether clamp 10 to close after clamping body 50 is received in throat portion 24. As shown, garment material 30 could be free end 32 folded on itself to define first material fold 34 along clamping body 50.

Figure 7:
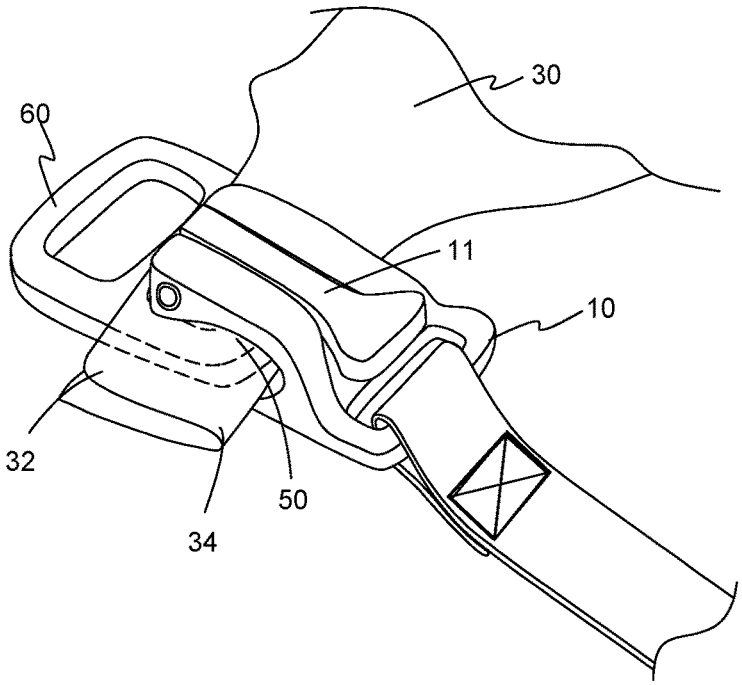
FIG. 7 illustrates a perspective view of the tether clamp assembly of FIG. 6 showing the tether clamp after installation on the material and clamping body.

Referring now to FIG. 7, a perspective view shows tether clamp 10, closed-loop connector 60, and garment material 30 of FIG. 6 after installation of tether clamp 10 over clamping body 50 and first material fold 34. First material fold 34 and clamping body 50 are received in throat portion 24 and clamp lever 11 has been moved to the closed position. As such, two plies of garment material 30 extend through mouth portion 22 and are gripped between clamping portion 16 and lower body arm 18 (not visible). As illustrated, clamping portion 16 extends through opening 62 (shown in FIG. 6) of closed-loop connector 60 to engage garment material 30 with lower body arm 18.

Figure 8:
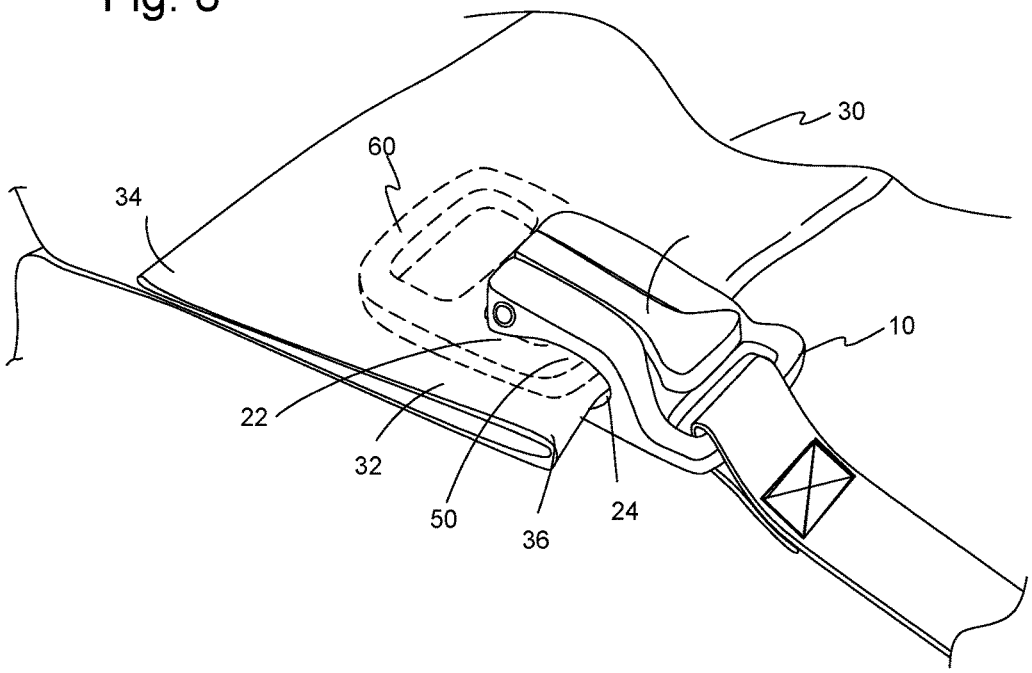
FIG. 8 illustrates an example of a tether clamp assembly installed on a garment material using a four-ply installation and a clamping body that is part of a closed-loop connector.

Referring now to FIG. 8, perspective view shows tether clamp 10 installed in a four-ply configuration on garment material 30 and clamping body 50 as part of closed-loop connector 60. Garment material 30 is folded on itself to define first material fold 34, which is then folded over clamping body 50 to define second material fold 36 along clamping body 50. Second material fold 36 and clamping body 50 are received in throat portion 24 by insertion through mouth portion 22. Clamp lever 11 has been moved to the closed position so that clamping portion 16 (not visible) engages garment material 30. As such, four plies of garment material 30 are griped in mouth portion 22 between clamping portion 16 and lower body arm 18 (not visible; shown in FIG. 2A).

Figure 9:
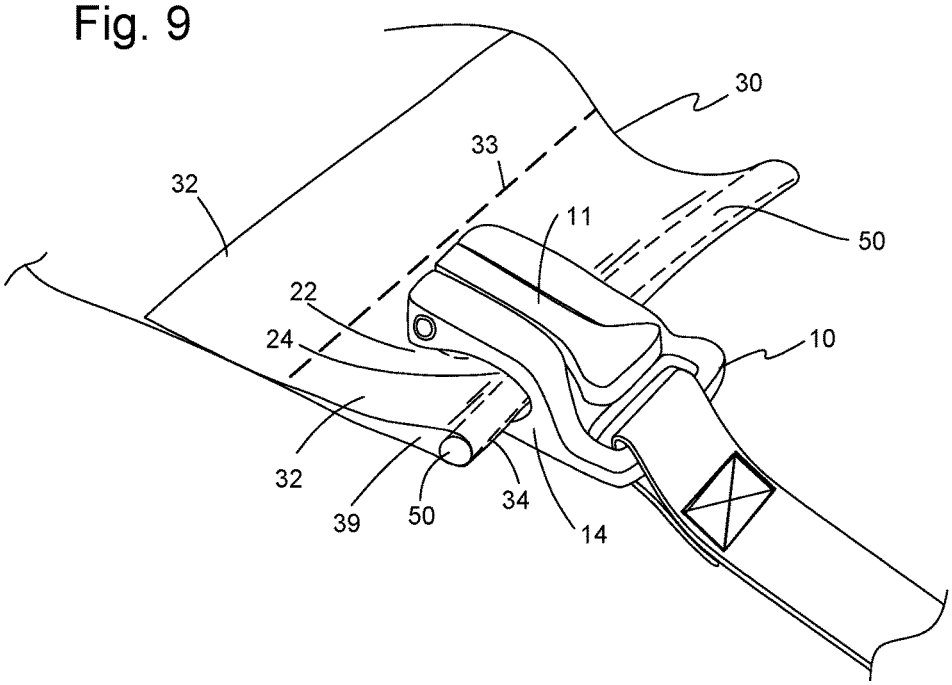
FIG. 9 illustrates an example of a tether clamp assembly installed on a garment material using a two-ply installation with the clamping body retained within a hem of the garment.

Referring now to FIG. 9, perspective view shows tether clamp 10 installed in a two-ply configuration on garment material 30 and clamping body 50, where clamping body 50 is retained in a hem or other compartment 39 of a wearable garment. Free end 32 of garment material 30 is folded over clamping body 50 to define first material fold 34 along clamping body 50. First material fold 34 and clamping body 50 are received in throat portion 24 with two plies of garment material 30 extending through mouth portion 22 of tether clamp 10. Clamp lever 11 has been moved to the closed position so that two plies of garment material 30 are engaged in mouth portion 22 between clamping portion 16 and lower body arm 18 (not visible; shown in FIG. 2A).

For example, compartment 39 is between plies of first material fold 34 formed as a hem along the bottom end of a smock or lab coat. In another example, first material fold 34 is formed along a seam, opening, or pocket on the garment. Garment material 30 is secured to itself with stitching 33 or fasteners to envelop and retain clamping body 50. Garment body 50 could be a length of plastic, metal, cord, or other material. Clamping body 50 may have a length just sufficient to be captured by tether clamp 10, or it may extend up to the full length along first fold 34. For example, clamping body 50 is a length of cord that extends along the hem at the bottom edge of a smock or lab coat. In another example, first fold 34 is formed horizontally or along the chest of a coverall garment and envelops a length of plastic cord or along a seam in the garment.

Figure 10:
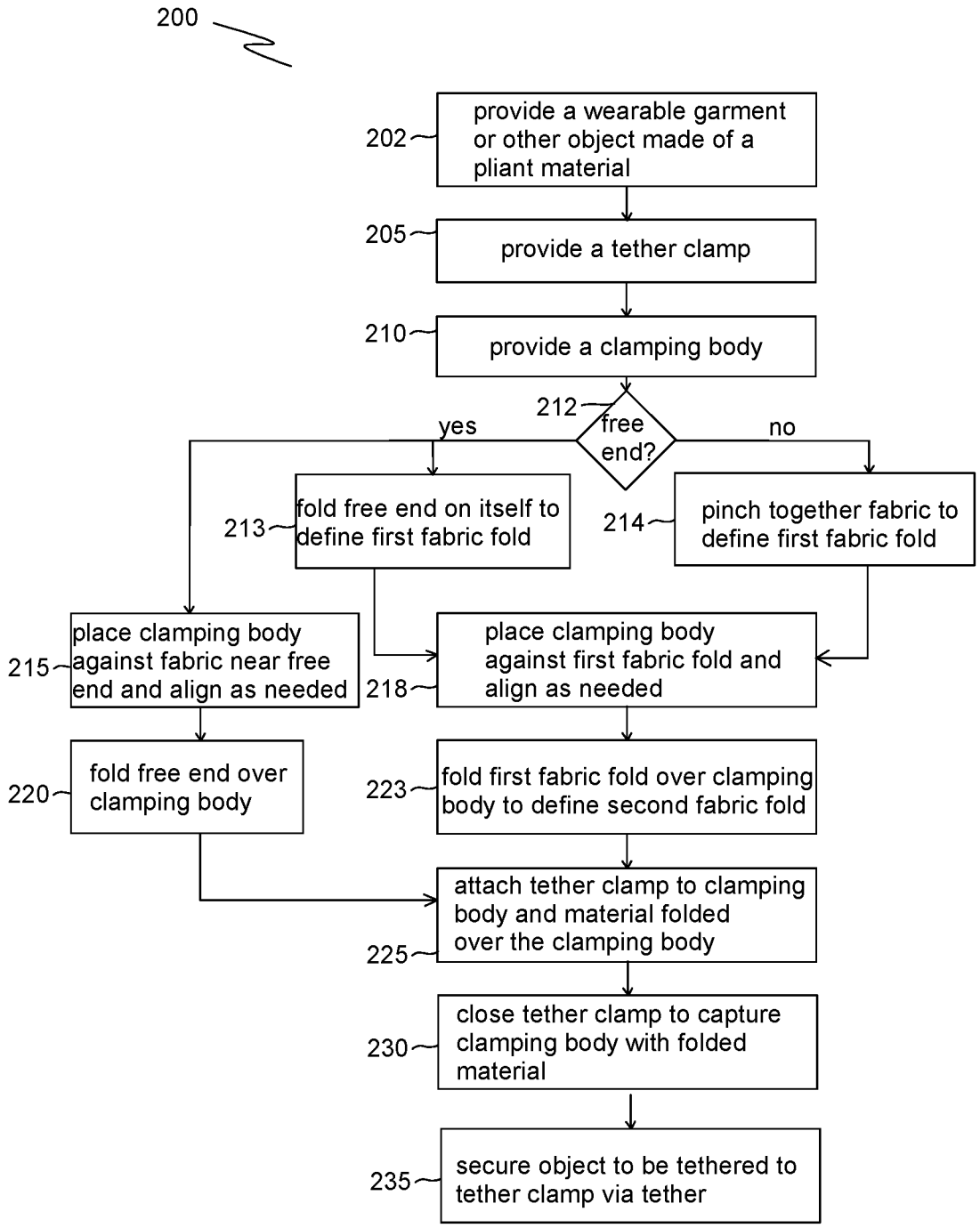
FIG. 10 is a flow chart illustrating steps in one embodiment of a method of attaching a tether clamp assembly to a wearable garment of the present invention

Referring now to FIG. 10, a flow chart illustrates steps of one embodiment of a method 200 of attaching tether clamp 10 to a wearable garment made of a pliant garment material 30. Garment material 30 may be a shirt, smock, gown, coverall, vest, apron, or any other garment with or without a free end 32. In step 202, a wearable garment or other object made of pliant garment material 30 is provided. In some embodiments, garment material 30 is made of nylon, flash-spun high-density polyethylene sold as Tyvek®, polypropylene, spunbound polypropylene, polyester, acetate, chlorinated polyethylene, neoprene, microporous materials, polyethylene-coated microporous materials, disposable paper, dissolvable paper, cotton/polyester blend, or 100% cotton. For example, the wearable garment is made of a light-weight nylon or polyester, paper, paper-like material, plastic, or polymer with a thickness less than 0.030 inch. In some embodiments, the wearable garment is a disposable laboratory garment or cleanroom garment made of a garment material 30 with a thickness less than 0.020 inch or less than 0.010 inch.

In step 205, a tether clamp 10 is provided. In some embodiments, tether clamp 10 has a clamp body 14 with a mouth portion 22 and a throat portion 24 extending into clamp body 14 from the mouth portion 24. Tether clamp 10 in some embodiments has a clamp lever 11 with a handle portion 12 and a clamping portion 16 operable between an open position and a closed position, where clamping portion 16 operably interacts with the mouth portion 24 to form a clamping structure 25 to engage and grip garment material 30. In some embodiments, tether clamp 10 is selected to include a tether 40 attached to tether clamp 10. In other embodiments, tether clamp 10 is a spring clamp, a suspender clamp, or other clamp.

In step 210, clamping body 50 is provided, where clamping body 50 extends from a first end 52 to a second end 54. Clamping body 50 has a cross sectional size and shape capable of passing through mouth portion 22 when tether clamp 10 is in the open position and sized to be captured in throat portion 24 when tether clamp 10 is in the closed position. In one embodiment, clamping body 50 is sized so that first end 52 and second end 54 extend out of tether clamp 10 when it is received in throat portion 24.

In step 212, one optionally determines whether the garment or object has an available free end 32 of garment material 30, and if so, whether the user wishes to attach tether clamp 10 to free end 32.

In step 215 of one embodiment of method 200 where free end 32 will be used, clamping body 50 is placed against garment material 30 near free end 32 and generally aligned with free end 32 of garment material 30. Alignment with free end 32 is preferable, but not required. In step 220, free end 32 of material 30 is folded over clamping body 50 so that tether clamp 10 engages at least two layers of garment material 30 when moved to the closed position. Alternately, in step 213 of another embodiment of method 200, the free end 32 of garment material 30 is first folded on itself to define first material fold 34.

Alternately in step 214, in cases where the garment lacks a free end 32 of material 30 or when the user chooses not to use free end 32 for attachment of tether clamp 10, garment material 30 at a middle portion of the wearable garment (e.g., the torso region) of is pinched or drawn together to define first material fold 32. In step 218, clamping body 50 is then placed against and generally aligned with first material fold 34.

In step 223, whether first material fold 34 is formed with free end 32 or with garment material 30 at the middle portion of the wearable garment, first material fold 34 is folded over clamping body 50 to define a second material fold 36 with clamping body 50 extending axially therethrough. In doing so, first material fold 34 is folded over clamping body 50 so that tether clamp 10 can engage and grip four layers of garment material 30 when tether clamp 10 is moved to the closed position.

In step 225, tether clamp 10 is attached over clamping body 50 and garment material 30. Clamping body 50 with material 30 folded over clamping body 50 is inserted through mouth portion 22 and into throat portion 24 of tether clamp 10 with clamping body 50 extending axially through throat portion 24 and positioned behind mouth portion 22. In some embodiments, first material fold 34 and clamping body 50 are received in throat portion 24 of tether clamp 10 so that tether clamp 10 grips two layers of garment material 30 in the closed position. In other embodiments, second material fold 36 and clamping body 50 are received in throat portion 24 of tether clamp 10 so that tether clamp 10 grips four layers of garment material 10 in the closed position.

In step 230, tether clamp 10 is moved to the closed position to capture in throat portion 24 the clamping body 50 with garment material 30 folded over the clamping body 50. In doing so, the clamping structure 25 captures at least two plies of material 30 extending through mouth portion 24. When free end 32 is folded on itself or when the middle portion of material 30 is brought together to define first material fold 34, the first material fold 34 is folded over clamping body 50 to result in four plies of material 30 extending out through mouth portion 22. When free end 32 of material 30 is folded over clamping body 50 as in steps 215 and 220, two plies of material 30 extend out through mouth portion 22.

In optional step 235, an object to be tethered (not shown) is secured to tether clamp 10 by tether 40, where first tether end **40*a* is secured to tether clamp 10. Optionally, second tether end 40*b* is secured to or extends through the object to be tethered. If the object is dropped, tether clamp 10 maintains its grip on material 30 due to the increased size and physical barrier imposed by clamping body 50 located in throat portion 24 of tether clamp 10. Thus, even when tether clamp 10 has a different clamp operation than embodiments discussed above, such as when a tether clamp 10 has spring-biased jaws, tether clamp 10 must open sufficiently to allow garment material 30 and clamping body 50 to pass through mouth portion 22 in order to separate from garment material 30**.

Figure 3A:
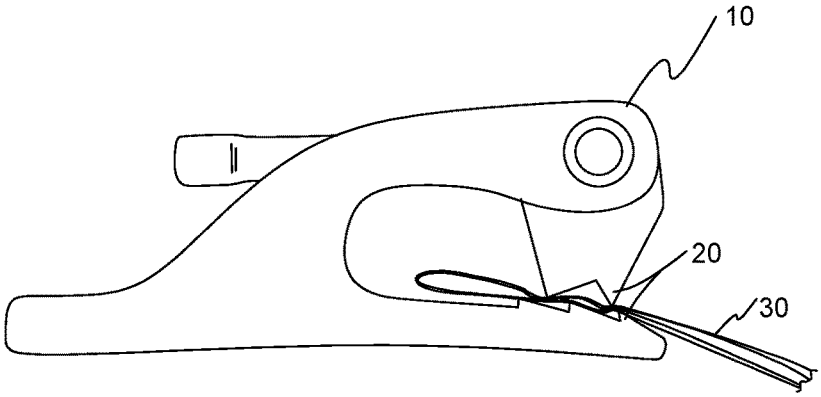
Fig. 3A (prior art)
FIG. 3A illustrates a side elevational view of the tether clamp of FIG. 1A showing two plies of material in the mouth portion of the tether clamp.
Figure 3B:
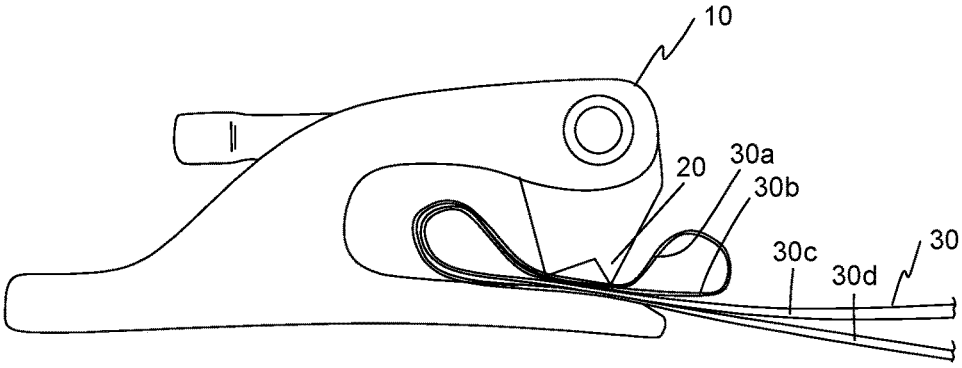
Fig. 3B (prior art)
FIG. 3B illustrates a side elevational view of the tether clamp of FIG. 1A showing four plies of material in the mouth portion of the tether clamp.

Drop Test Data for Traditional Tethering Method: Tether Clamp Attached to Garment Material Without a Clamping Body Table 1 below shows results of drop tests for various garment materials 30 performed to evaluate the weight capacity of tether clamp 10 of FIG. 1A attached to garment material 30 using a traditional attachment method as illustrated in FIG. 3B. Except as noted, tether clamp 10 was closed on four plies of garment material 30 placed in the mouth portion 22 and throat portion 24 of tether clamp 10.

Figure 1A:
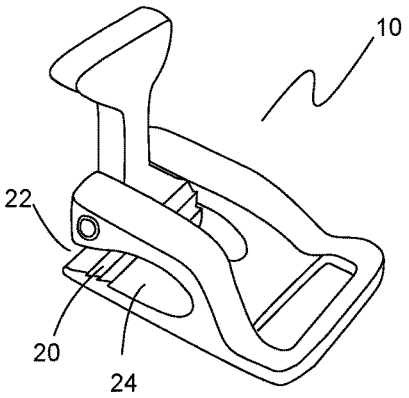
Figure 1A (prior art)
FIGS. 1A-1D illustrate perspective views of examples of tether clamps of the prior art.

The drop tests used a tether with a length of fourteen inches between tether clamp 10 at one end and a weight attached at the other end of the tether. In successive drops, the weight was increased in ¼-pound increments until tether clamp 10 pulled free from garment material 30. Tether clamp 10 in these drop tests is a plastic lever-operated clamp as illustrated in FIG. 1A. The weight was dropped from a height of fourteen inches above tether clamp 10 for a total drop distance of 28 inches.

Garment materials 30 were (1) 100% cotton in the form of a T-shirt sold under the trademark Gildan®, (2) a wicking cotton blend material with 53% combed cotton/47% polyester sold under the trademark Extreme Edry®, (3) a dissolvable paper in the form of a coverall sold under the trademark Orex® Deluxe, (4) a disposable paper in the form of a coverall sold under the trademark SoffTech Plus®, and (5) woven 1" nylon webbing in the form of a body harness with a thickness of about 1/16 inch. Except for the nylon webbing, all garment materials 30 were folded on themselves twice to provide four plies of garment material 30 between teeth 20 as illustrated in FIG. 3B. For the nylon webbing, tether clamp 10 was clamped onto a single thickness (ply) of the webbing.

For comparison, the 1.0"-wide nylon webbing of this drop test is consistent with nylon webbing used for backpack straps, lanyards, and the like, which typically has a thickness of 0.050" or greater. In comparison, woven sheet products sold under the trademark Tyvek® typically have a thickness of 0.006"-0.010", cotton dress shirts have a thickness of 0.006-0.014", light-weight nylon and polyester have a thickness of about 0.006", and a sheet of uncoated 20 lb. paper has a thickness of about 0.0035".

Garment material 30 passed a drop test when the tether clamp 10 remained attached to garment material 30 after the drop; the weight was then increased in ¼-pouhc increments for subsequent drops. A drop test failure was reported when tether clamp 10 pulled free from the garment material 30. The failed test results in Table 1 represent the weights at which garment material 30 failed the drop test; garment material 30 passed the previous drop tests using a total weight below this failure value. In some cases, tether clamp 10 remained connected to material 30, but garment material 30 ripped; in such cases, the tensile strength of garment material 30 is the limiting factor, not the tether clamp 10 or the attachment method.

TABLE 1

Drop-test data for tether clamp attached to garment material without clamping body

| Garment Material 30 | Garment Material Thickness (1-ply, in inches) | Garment Material Tensile Strength (lbs.) | Maximum Dropped Weight Without Failure (nearest ¼ lb., one drop) |
|---|---|---|---|
| (1) 100% Cotton (Gildan ®) | 0.016 | 15 | 1.25 lbs. |
| (2) Cotton/ Polyester blend (Extreme Edry ®) | 0.0135 | 28 | 1.25 lbs. |
| (3) Dissolvable paper (Orex ® deluxe) | 0.019 | 41.5 | 0.75 lbs. |
| (4) Disposable paper (SoftTech Plus ®) | 0.024 | 28 | 0.75 lbs. |
| (5) Woven 1" Nylon webbing | ~0.06 | | 2.0 lbs. |

Note:
All garment materials were tested without a clamping body and using a 4-ply installation as shown in FIG. 3. Nylon webbing was tested without a clamping body and using the tether clamp attached to 1-ply of the webbing.

First material fold 34 and clamping body 50 are received in throat portion 24 with two plies of garment material 30 extending through mouth portion 22 of tether clamp 10. Clamp lever 11 has been moved to the closed position so that two plies of garment material 30 are engaged in mouth portion 22 between clamping portion 16 and lower body arm 18 (not visible; shown in FIG. 2A).

As shown by the test data of Table 1, nylon webbing passed drop tests up to 2.0 lbs. while other materials passed with a maximum weight of 0.75 lbs. or 1.25 lbs. Since four plies of the thinner garment materials 30 have a combined thickness comparable to the thickness of the nylon webbing, this difference in maximum weight may be due in part to the webbing having a more textured surface that allows teeth 20 to penetrate slightly and/or engage the webbing. The difference in maximum weight may also or alternately be due to the single-ply structure of the webbing compared to the 4-ply structure of other garment materials 30 used in the drop tests.

Drop Test Data for Nylon using Traditional Tethering Method Without a Clamping Body Tables 2A and 2B below show results of drop tests performed with 200 denier nylon and 500 denier nylon garment material 30, respectively, using tether clamp 10 attached to garment material 30 without clamping body 50. In these drop tests, plies of garment material 30 are not stitched together (or otherwise secured to itself) outside of tether clamp 10. The weight was increased in 0.5-ounce increments. Drop test data in Table 2A is for 200 denier nylon using the traditional 2-ply and 4-ply clamping configurations without a clamping body 50 as shown in FIGS. 2 and 3, respectively. Drop test data in Table 2B is for 500 denier nylon using the traditional 2-ply and 4-ply clamping configurations without a clamping body 50 as shown in FIGS. 2 and 3, respectively.

TABLE 2A

Drop Test Data for 200 Denier Nylon Without Clamping Body

Figure 1B:
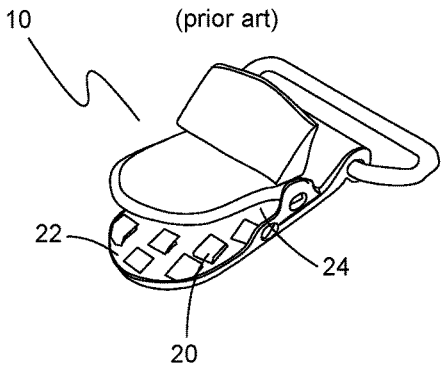
Figure 1B (prior art)
Figure 1C:
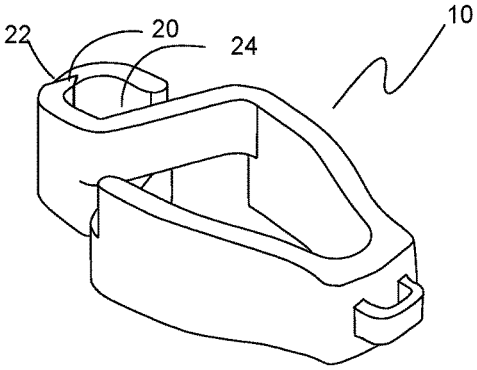
Figure 1C (prior art)
Figure 1D:
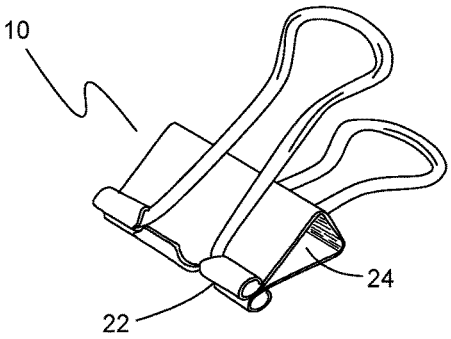
Figure 1D (prior art)

| Tether Clamp Style | Garment Material | # Plies (not stitched) | Maximum Dropped Weight Without Failure |
|---|---|---|---|
| FIG. 1A | 0.0075" 200 denier nylon | 2 | 3.0 oz. |
| FIG. 1B | 0.0075" 200 denier nylon | 2 | 2.0 oz. |
| FIG. 1C | 0.0075" 200 denier nylon | 2 | 1.5 oz. |
| FIG. 1D | 0.0075" 200 denier nylon | 2 | 1.0 oz. |
| FIG. 1A | 0.0075" 200 denier nylon | 4 | 4.0 oz. |
| FIG. 1B | 0.0075" 200 denier nylon | 4 | 4.0 oz. |
| FIG. 1C | 0.0075" 200 denier nylon | 4 | 2.0 oz. |
| FIG. 1D | 0.0075" 200 denier nylon | 4 | 1.5 oz. |

TABLE 2B

Drop Test Data for 500 Denier Nylon Without Clamping Body

| Tether Clamp Style | Garment Material | # Plies (not stitched) | Maximum Dropped Weight Without Failure |
|---|---|---|---|
| FIG. 1A | 0.0145" 500 denier nylon | 2 | 4.0 oz. |
| FIG. 1B | 0.0145" 500 denier nylon | 2 | 3.0 oz. |
| FIG. 1C | 0.0145" 500 denier nylon | 2 | 2.0 oz. |
| FIG. 1D | 0.0145" 500 denier nylon | 2 | 1.5 oz. |
| FIG. 1A | 0.0145" 500 denier nylon | 4 | 8.0 oz. |
| FIG. 1B | 0.0145" 500 denier nylon | 4 | 5.0 oz. |
| FIG. 1C | 0.0145" 500 denier nylon | 4 | 2.5 oz. |
| FIG. 1D | 0.0145" 500 denier nylon | 4 | 2.0 oz. |

The maximum dropped weight was on the order of ounces when tether clamp 10 is attached to nylon without clamping body 50. For the 200-denier nylon garment material 30, the maximum weight did not exceed 4.0 ounces for any tether clamp 10 tested, even when using a four-ply installation. The increased thickness of the 500-denier nylon (approximately twice as thick) is likely responsible for the increase in maximum dropped weight of the 500-denier nylon compared to the 200-denier nylon since tether clamp 10 is better able to engage the thicker garment material 30. Consistent with this theory, Tables 2A and 2B show the maximum dropped weight of four plies of 200-denier nylon to be about the same as the maximum dropped weight of two plies of 500-denier nylon.

Drop Test Data for Tethering Method with Tether Clamp Attached to Garment Material Using Clamping Body Table 3 below shows results of drop tests performed with the same garment materials 30 and tether clamp 10 used for the drop tests with traditional attachment discussed above for Table 1. Drop test data in Table 3 was obtained using the 4-ply clamping configuration with a clamping body 50 as described above for method 200 and as shown in FIGS. 5B and 10. Clamping body 50 was part of a plastic closed-loop connector 60 as shown in FIG. 6, where clamping body 50 has a generally rectangular cross-sectional shape with dimensions of 0.12"×0.20".

Garment material 30 was folded on itself or pinched together to define first material fold 32, then first material fold 32 was folded over clamping body 50 to define second material fold 36. Tether clamp 10 was then clamped over second material fold 36 and clamping body 50 with four plies of material 30 extending out of mouth portion 22 between teeth 20 and clamping body 50 extending axially through throat portion 24 of tether clamp 10. As with the drop test for data of Table 1, tether 40 had a length of fourteen inches between tether clamp 10 and a weight (not shown). The nylon webbing was not tested in these drop tests because it was too thick to be folded and fit into the mouth portion 24 of tether clamp 10.

After successfully passing a single drop test with a 1.0 lb. weight, the amount of weight was increased in 1.0 pound increments until failure occurred either by garment material 30 ripping or tether clamp 10 pulling free from garment material 30. Three drops were performed at each weight. To pass the drop test at a given weight, tether clamp 10 must not pull free from garment material 30 after three drops. In some drop tests, failure occurred when garment material 30 ripped (a tensile stress failure) on the second or third drop, rather than tether clamp 10 pulling free from material 30. In drop tests where garment material 30 ripped, the attachment of tether clamp 10 was stronger than garment material 30 itself.

Each garment material 30 passed three drops of the total weight listed in Table 2. That is, the tether clamp 10 remained attached to garment material 30 without pulling free from garment material 30. The cotton/polyester garment material 30 sold as Extreme Edry® ripped partially on the third drop with a five pound weight, but tether clamp 10 remained attached to garment material 30. Tether clamp 10 attached to 100% cotton material 30 by Gildan® failed when tether clamp 10 pulled free from garment material 30 on the second drop with a four pound weight, but passed three drops with a three pound weight. The dissolvable paper garment material 30 sold as Orex® Deluxe failed on the third drop with a five pound weight due to ripping of garment material 30, but passed three drops with a four pound weight. The disposable paper garment material 30 sold as SoftTech Plus® failed due to ripping of the garment material 30 on the second drop with three pounds, but passed three drops with a two pound weight.

TABLE 3

Drop-test data for tether clamp attached to garment materials using clamping body

| Garment Material | Max. dropped Weight Without Failure (three drops) | Ratio/% increase compared to traditional method without clamping body |
|---|---|---|
| (1) 100% Cotton (Gildan ®) | 3.0 Lbs. | 2.4/140% |
| (2) Cotton/ Polyester blend (Extreme Edry ®) | 5.0 Lbs. | 4.0/300% |
| (3) dissolvable paper (Orex ® deluxe) | 4.0 Lbs. | 5.3/433% |
| (4) Disposable paper (SoftTech Plus ®) | 2.0 Lbs. | 2.6/166% |

Note:
All garment materials 30 were tested with a clamping body 50 and using a 4-ply installation as described in method 200 and shown in FIG. 5B & 10.

The results of drop tests in Table 3 use method 200 of attaching a tether clamp 10 as discussed above with reference to FIGS. 5B and 10, where method 200 includes step 214 of pinching together the garment material to define a first fabric fold. The test results show that clamping method 200 increased the load capacity of tether clamp 10 to the extent that failure occurred due to tensile stress failure of garment material 30 itself rather than tether clamp 10 pulling free from garment material 30.

The maximum dropped weight without failure of the Gildan 100% cotton increased from 1.25 lbs. to 3.0 lbs. with slight ripping of garment material 30 (previously failing at 1.5 lbs.). The maximum dropped weight without failure of the Extreme Edry cotton/polyester blend garment material 30 quadrupled from 1.25 lbs. to 5.0 lbs. (previously failing at 1.5 lbs.). The maximum dropped weight without failure of the Orex® deluxe disposable paper garment material 30, more than doubled from 1.75 pounds to 4.0 pounds. The maximum dropped weight without failure of the SoftTech Plus® dissolvable paper garment material 30 was more than quintupled from 0.75 lb. to 4.0 lbs. (previously failing at one pound). In summary, clamping method 200 using a 4-ply installation with clamping body 50 significantly increased the maximum dropped weight of all garment materials 30 tested. Using method 200, a failure occurred due to a tensile strength failure of garment material 30 rather than from tether clamp 10 pulling free from garment material 30.

Drop Test Data for Tethering Method 200: Tether Clamp Attached to Nylon Garment Material Using a Clamping Body Tables 4A and 4B below show results of drop tests performed with 200-denier nylon and 500-denier nylon garment material 30, respectively, using tether clamp 10 and clamping body 50. In these drop tests, garment material 30 is not stitched together (or otherwise secured to itself) outside of tether clamp 10. Drop test data in Table 4A was obtained using the 2-ply clamping configuration with a clamping body 50 as described above for method 200 and as shown in FIGS. 5A and 10, where clamping body 50 has a generally rectangular cross-sectional shape with dimensions of 0.12"×0.20". Drop test data in Table 4B was obtained using the 4-ply clamping configuration with the same clamping body 50 as described above for method 200 and as shown in FIGS. 5B and 10.

TABLE 4A

Drop Test Data for 200 denier nylon garment material with clamping body

| Tether Clamp Style | Garment Material | # Plies | Maximum Dropped Weight Without Failure | Max weight vs. without clamping body |
|---|---|---|---|---|
| FIG. 1A | 0.0075" 200 denier nylon | 2 | 1.5 lbs. | 8x |
| FIG. 1B | 0.0075" 200 denier nylon | 2 | 0.75 lbs. | 6x |
| FIG. 1C | 0.0075" 200 denier nylon | 2 | 1.5 oz. | 1x |
| FIG. 1D | 0.0075" 200 denier nylon | 2 | 1.5 oz. | 1.5x |
| FIG. 1A | 0.0075" 200 denier nylon | 4 | 2.0 lbs. | 8x |
| FIG. 1B | 0.0075" 200 denier nylon | 4 | 1.0 lbs. | 4x |
| FIG. 1C | 0.0075" 200 denier nylon | 4 | 3.0 oz. | 1.5x |
| FIG. 1D | 0.0075" 200 denier nylon | 4 | 3.0 oz. | 2x |

TABLE 4B

Drop Test Data for 500 denier nylon garment material with clamping body

| Tether Clamp Style | Garment Material | # Plies | Maximum Dropped Weight Without Failure | Max weight vs. without clamping body |
|---|---|---|---|---|
| FIG. 1A | 0.0145" 500 denier nylon | 2 | 1.5 lbs. | 6x |
| FIG. 1B | 0.0145" 500 denier nylon | 2 | 1.0 lbs. | 5.3x |
| FIG. 1C | 0.0145" 500 denier nylon | 2 | 3 oz. | 1.5x |
| FIG. 1D | 0.0145" 500 denier nylon | 2 | 3 oz. | 2x |
| FIG. 1A | 0.0145" 500 denier nylon | 4 | 2.5 lbs. | 5x |
| FIG. 1B | 0.0145" 500 denier nylon | 4 | 1.0 lbs. | 3.2x |
| FIG. 1C | 0.0145" 500 denier nylon | 4 | 4.5 oz. | 1.8x |
| FIG. 1D | 0.0145" 500 denier nylon | 4 | 3.0 oz. | 1.5x |

Overall, the 200-denier nylon garment material 30 in all cases had an equal or lower maximum weight without failure than 500-denier garment material 30 using a 2-ply or 4-ply installation. The 4-ply installation had an increased maximum weight without failure in all drop tests for 200-denier nylon. For 500-denier nylon, the 4-ply installation resulted in an equal or greater maximum dropped weight without failure in all drop tests.

Compared to drop tests using 200-denier and 500-denier nylon without clamping body 50 in Tables 2A and 2B above, the drop tests for nylon using clamping body 50 resulted in increases in the maximum weight without failure for all versions of tether clamps tested. For tether clamp 10 of FIG. 1A, using clamping body 50 increased the maximum dropped weight without failure by five to eight times.

Drop Test Data for Tethering Method 200: Tether Clamp Attached to Nylon Garment Material Using a Clamping Body Tables 5A and 5B below show results of drop tests performed with 200-denier nylon and 500-denier nylon garment material 30, respectively. These drop tests were performed using tether clamp 10 of FIG. 1A and clamping body 50, where plies of garment material 30 are either stitched or not stitched together outside of mouth portion 22 of tether clamp 10. Drop test data in Tables 5A-5B was obtained using the 2-ply and 4-ply clamping configuration with a clamping body 50 as described above for method 200 and as shown in FIGS. 5A-5B and 10, where clamping body 50 has a generally rectangular cross-sectional shape with dimensions of 0.12"×0.20" and garment material 30 is unstitched. The data of Table 5A is for 200-denier nylon that is not stitched together. The data of table 5B is for 500-denier nylon that is stitched together. Drop test data in Table 5B was obtained using the same 2-ply and 4-ply clamping configurations with clamping body 50 as described above for method 200 and as shown in FIGS. 5A-5B and 10, where garment material 30 is stitched together outside of mouth portion 22.

TABLE 5A

Drop Test Data for 200 Denier Nylon With Clamping Body, Unstitched

| Tether Clamp Style | Garment Material | # Plies (not stitched) | Maximum Dropped Weight Without Failure |
|---|---|---|---|
| FIG. 1A | 0.0075" 200 denier nylon | 2 | 1.5 lbs. |
| FIG. 1B | 0.0075" 200 denier nylon | 2 | 0.75 lbs. |
| FIG. 1C | 0.0075" 200 denier nylon | 2 | 1.5 oz. |
| FIG. 1D | 0.0075" 200 denier nylon | 2 | 1.5 oz. |
| FIG. 1A | 0.0075" 200 denier nylon | 4 | 2.0 lbs. |
| FIG. 1B | 0.0075" 200 denier nylon | 4 | 1.0 lbs. |
| FIG. 1C | 0.0075" 200 denier nylon | 4 | 3.0 oz. |
| FIG. 1D | 0.0075" 200 denier nylon | 4 | 3.0 oz. |

TABLE 5B

Drop Test Data for 200 Denier Nylon With Clamping Body 50, Stitched

| Tether Clamp Style | Garment Material | # Plies (stitched) | Maximum Dropped Weight Without Failure | Max weight. vs. unstitched |
|---|---|---|---|---|
| FIG. 1A | 0.0075" 200 denier nylon | 2 | 2.0 lbs. | 1.3x |
| FIG. 1B | 0.0075" 200 denier nylon | 2 | 1.0 lbs. | 1.3x |
| FIG. 1C | 0.0075" 200 denier nylon | 2 | 4.5 oz. | 3x |
| FIG. 1D | 0.0075" 200 denier nylon | 2 | 3.0 oz. | 2x |
| FIG. 1A | 0.0075" 200 denier nylon | 4 | 3.0 lbs. | 1.5x |
| FIG. 1B | 0.0075" 200 denier nylon | 4 | 1.0 lbs. | 1.0x |
| FIG. 1C | 0.0075" 200 denier nylon | 4 | 4.5 oz. | 1.5x |
| FIG. 1D | 0.0075" 200 denier nylon | 4 | 3.0 oz. | 1.0x |

The maximum dropped weight for tether clamp 10 attached using clamping body 50 increased in most cases when plies of garment material 30 are stitched together outside of mouth portion 22 of tether clamp 10. In most cases, the maximum dropped weight without failure was about 30-50% greater when plies of garment material 30 are stitched together. The maximum weight without failure was 2× and 3× for a 2-ply installation using tether clamps of FIGS. 1C and 1D, respectively. From this data, it appears that plies of garment material 30 being secured together (by stitching or other means) increases the maximum weight without failure for two-ply installations and in some cases for four-ply installations. It is believed that stitching the plies of garment material 30 together simulates having a thicker garment material 30 and eliminates the ability of individual plies of garment material 30 to pull free from tether clamp 10. As a result, the maximum weight without failure is increased.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A tethering method comprising:

providing a tether clamp comprising a clamp body having a mouth portion and a throat portion extending into the clamp body from the mouth portion, where the tether clamp is operable between an open position and a closed position;

providing a wearable garment made of a pliant material;

providing a clamping body having a first end and a second end, wherein a portion of the clamping body between the first end and the second end is sized to pass through the mouth portion when the tether clamp is in the open position and remain disposed in the throat portion of the clamp body when the tether clamp is in the closed position, each of the first end and the second end is sized greater than the throat portion thereby preventing the clamping body from passing axially through the throat portion when the tether clamp is in the closed position;

folding the pliant material over the clamping body, thereby providing the clamping body with a folded pliant material;

operating the tether clamp to the open position;

installing the clamping body with the folded material in the throat portion of the tether clamp with the clamping body extending axially through the throat portion and the folded material extending out through at least the mouth portion; and operating the tether clamp to the closed position, thereby capturing the clamping body with the folded material in the throat portion and engaging at least two plies of the pliant material in the mouth portion, wherein the clamping body is selectively securable to and removable from the wearable garment.

2. The method of claim 1 further comprising:

bringing together the pliant material to define a first material fold, wherein the step of folding the pliant material over the clamping body is performed by folding the first material fold over the clamping body.

3. The method of claim 2, wherein the step of bringing together the pliant material is performed by folding a material free end on itself.

4. The method of claim 1 further comprising attaching a first end of a lanyard to the tether clamp and having a second end adapted to be secured to an object to be tethered.

5. The method of claim 1, wherein the step of providing the tether clamp includes selecting the tether clamp from the group consisting of a spring clamp, a lever-operated clamp, a squeeze-action clamp, and a suspender clamp.

6. The method of claim 1, wherein the step of providing the tether clamp includes selecting the tether clamp to include a plurality of teeth in the mouth portion of the clamp body.

7. The method of claim 1, wherein the step of providing the clamping body includes selecting the clamping body having an overall length commensurate with a width of the tether clamp as measured from a first body side to a second body side of the clamp body at the throat portion.

8. The method of claim 1, wherein the step of providing the clamping body includes selecting the clamping body having an overall length that is less than a width of the tether clamp as measured from a first body side to a second body side of the clamp body at the throat portion.

9. The method of claim 1, wherein the clamping body at least partially extends out of the garment when the tether clamp is capturing the clamping body with the folded material in the throat portion.

10. The method of claim 1, wherein the clamping body is part of a closed loop connector and a first tether end of a tether is secured to the closed loop connector and a second tether end of the tether is secured to the tether clamp.

11. The method of claim 1, further comprising the step of operating the tether clamp to the open position and removing the clamping body from the folded material after the step of operating the tether clamp to the closed position.

12. The method of claim 1, wherein the clamping body is interconnected to a tether that extends from the clamping body positioned within the folded material.

13. In combination, a tether clamp, a clamping body, and a wearable garment, the combination comprising:

the tether clamp comprising:

a clamp body having a mouth portion and a throat portion extending into the clamp body from the mouth portion; and a clamp lever having a handle portion and a clamping portion operable between an open position and a closed position relative to the mouth portion of the clamp body;

the clamping body having a first end and a second end, a portion of the clamping body between the first end and the second end sized to pass through the mouth portion and into the throat portion of the tether clamp when the clamp lever is in the open position, wherein the portion of the clamping body is prevented from passing out through the mouth portion when the portion of the clamping body is disposed in the throat portion and the clamp lever is moved to the closed position, each of the first end and the second end is sized greater than the throat portion thereby preventing the clamping body from passing axially through the throat portion when the tether clamp is in the closed position, wherein the clamping body is selectively securable to and removable from the garment; and the wearable garment made of a pliant material, wherein a portion of the wearable garment is folded around the clamping body and disposed in the throat portion together with the portion of the clamping body and with the portion of the wearable garment extending out through at least the mouth portion, whereby the portion of the clamping body and the portion of the wearable garment are retained within the throat portion when the clamp lever is in the closed position.

14. The combination of claim 13, wherein the pliant material is selected from the group consisting of nylon, disposable paper, dissolvable paper, polyester, cotton/polyester blend, 100% cotton, silk, spun-bond polyolefin, polyethylene, and polypropylene.

15. The combination of claim 13, wherein the clamping body is part of a closed-loop connector selected from the group consisting of a D-ring, a buckle, a square ring loop, and a slide buckle.

16. The combination of claim 13, wherein the clamping body is secured within a compartment defined by the pliant material of the wearable garment.

17. The combination of claim 16, wherein the compartment is defined by a hem.

18. The combination of claim 13, wherein the clamping body at least partially extends out of the garment.

19. The combination of claim 13, further comprising a tether having first and second tether ends; wherein the clamping body is part of a closed loop connector; further wherein the first tether end is secured to the clamping body and the second tether end is secured to the tether clamp.

* * * * *